US010695928B2

(12) United States Patent
Nguyen-DeMary et al.

(10) Patent No.: US 10,695,928 B2
(45) Date of Patent: Jun. 30, 2020

(54) ROTARY ROD SLICER

(71) Applicant: Merck Sharp & Dohme Corp., Rahway, NJ (US)

(72) Inventors: Tinh Nguyen-DeMary, Milltown, NJ (US); Raymond Kenneth Seto, Linden, NJ (US)

(73) Assignee: Merck Sharp & Dohme Corp., Rahway, NJ (US)

( * ) Notice: Subject to any disclaimer, the term of this patent is extended or adjusted under 35 U.S.C. 154(b) by 0 days.

(21) Appl. No.: 16/282,038

(22) Filed: Feb. 21, 2019

(65) Prior Publication Data

US 2020/0070378 A1 Mar. 5, 2020

Related U.S. Application Data

(60) Provisional application No. 62/727,531, filed on Sep. 5, 2018.

(51) Int. Cl.
*B26D 3/16* (2006.01)
*A61J 3/08* (2006.01)

(52) U.S. Cl.
CPC ..... *B26D 3/16* (2013.01); *A61J 3/08* (2013.01); *B26D 3/166* (2013.01)

(58) Field of Classification Search
CPC . B26D 3/16; B26D 3/166; B26D 3/169; A61J 3/08
USPC ..... 83/703; 30/95
See application file for complete search history.

(56) References Cited

U.S. PATENT DOCUMENTS

| | | | | |
|---|---|---|---|---|
| 6,553,880 | B2 * | 4/2003 | Jacobsen | A61M 25/0009 451/10 |
| 2002/0078808 | A1 * | 6/2002 | Jacobsen | A61M 25/0009 83/282 |
| 2011/0023676 | A1 * | 2/2011 | Booms | B26D 1/1575 83/322 |
| 2011/0107601 | A1 * | 5/2011 | Crainich | A61B 17/8863 30/95 |
| 2016/0263761 | A1 * | 9/2016 | Droege | B26D 1/58 |
| 2017/0106552 | A1 * | 4/2017 | Shibayama | B26D 3/16 |
| 2017/0305096 | A1 * | 10/2017 | Dettori | B26D 1/60 |
| 2018/0133814 | A1 * | 5/2018 | Pierce | B26D 3/16 |
| 2018/0214957 | A1 * | 8/2018 | Conrad | B23B 29/26 |
| 2019/0022773 | A1 * | 1/2019 | Choi | B23C 1/12 |
| 2019/0099909 | A1 * | 4/2019 | Mazzaccherini | B26D 1/16 |
| 2019/0168318 | A1 * | 6/2019 | Thurre | B23D 25/04 |

* cited by examiner

*Primary Examiner* — Omar Flores Sanchez
(74) *Attorney, Agent, or Firm* — Fenwick & West LLP

(57) ABSTRACT

A rod slicer includes a receiving vessel, a cover vessel, and a rod mount. The rod mount may releasably couple with the cover vessel. At least one blade is mounted to or within the cover vessel. The rod mount has openings for one or more rods. The rod mount can be rotated, causing any rods in the openings to pass across from the rod mount into the cover vessel. In the cover vessel, a slicing edge of the blade, thus cutting a segment of a desired length from the rod. A pump may be connected to an opening in the vessel to vacuum the cut segments into the vessel. In some configurations, the blade is adjustable to change the length of the segments.

18 Claims, 4 Drawing Sheets

ROTARY ROD SLICER

CROSS REFERENCE TO RELATED APPLICATIONS

This application claims a benefit of U.S. Patent Application No. 62/727,531, filed on Sep. 5, 2018, the contents of which is incorporated by reference in its entirety.

TECHNICAL FIELD

The subject matter described relates generally to cutting rods into segments of a desired length, and in particular, to slicing implant rods into subcutaneous implants to specific sizes.

BACKGROUND

Delivery of drugs may occur via implants. Often an implant is manufactured as a long, thin rod. The implant rod must be precisely cut into segments of a specified size, for example, for use in testing. However, the rods may be fragile in their composition and must be manually cut in order to get the precise size needed for a medical application, while keeping the remainder of the rod intact for further use. The task of cutting the rod is time-consuming and may lead to imprecise cuts. Moreover, the fragile nature of the rods may also cause rods to fracture or break during the cutting process. The fracture or the break may be to the portion intended to be cut the sized length and/or the remaining portion of the rod thereby causing the rod to be unusable in whole or in part due to the inadvertent breakage.

DETAILED DESCRIPTION

Figure 1:
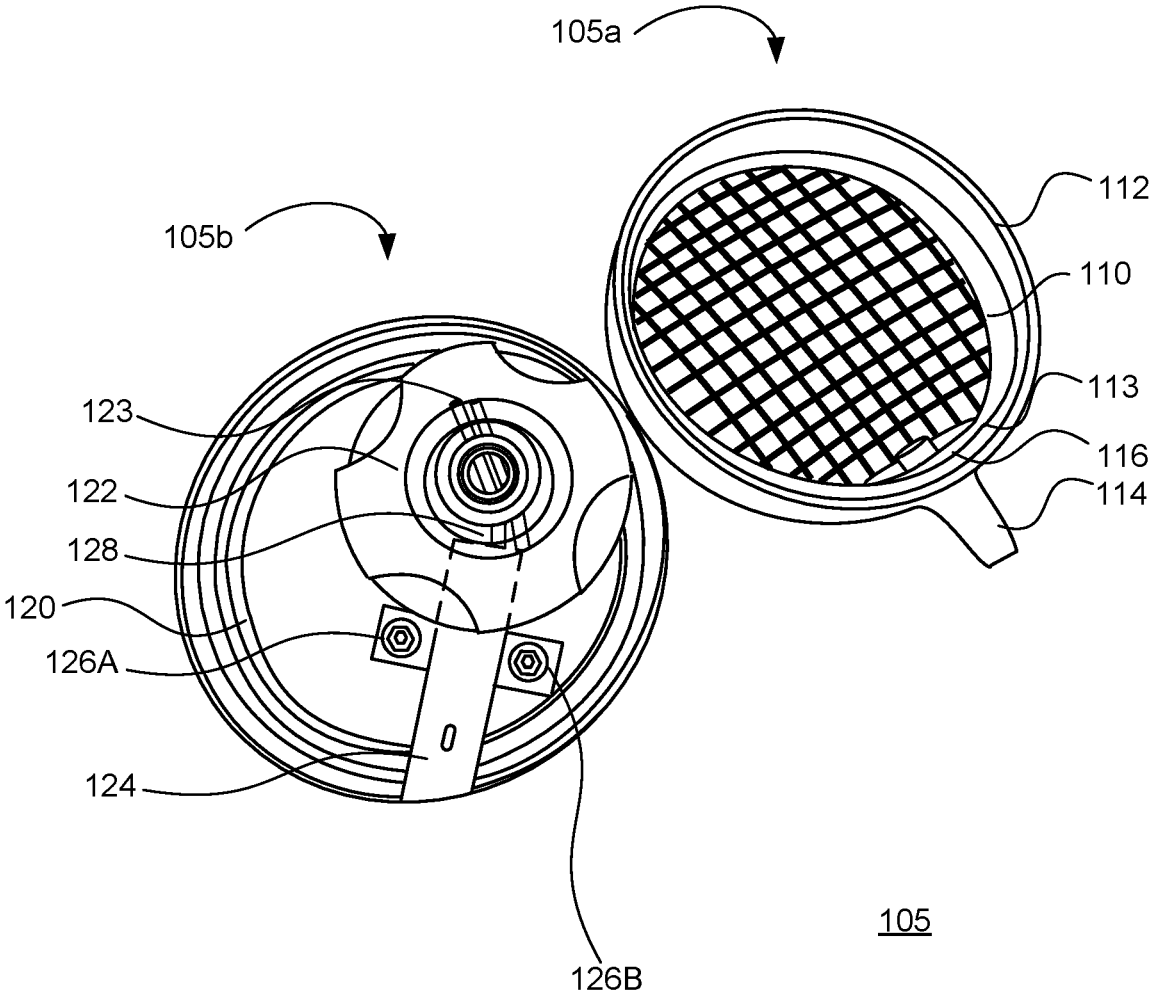
FIG. 1 is a first view of an example rotary rod slicer with a cover removed from a corresponding cylindrical vessel in accordance with one embodiment.

The Figures (FIGS.) and the following description describe certain embodiments by way of illustration only. One skilled in the art will readily recognize from the following description that alternative embodiments of the structures and methods may be employed without departing from the principles described. Reference will now be made to several embodiments, examples of which are illustrated in the accompanying figures. It is noted that wherever practicable similar or like reference numbers are used in the figures to indicate similar or like functionality.

Configuration Overview

Disclosed is a rod slicer structured to precisely slide rods (e.g., rod-shaped implants for drug delivery) into segments of precise sizes. Rods for implants have a very small diameter (e.g., 0.5 millimeters (mm) to 2.0 mm) and are of small length (e.g., 1 millimeters (mm) to 10 mm (although some rods may be longer in length)). The rods may be constructed from SILASTIC or other medical grade material. Their small size and material make up may cause them to fracture or break during a cutting process, e.g. to appropriately size the rod for use in a medical process.

To help precisely cut the implant rods, disclosed is a slicer. In various embodiments, the slicer includes a receiving vessel (e.g., a cylindrical receiving vessel), a cover vessel for the receiving vessel, and a rod mount coupled to the cover vessel. Although the terms "slice" and "slicer" are used for convenience, it should be appreciated that the rod may be cut, chopped, or otherwise divided into segments of the desired length. A pump may be connected to an opening in the vessel to create a pressure differential between the ambient conditions and the interior of the vessel. One or more blades are mounted to or within the cover disposed underneath the rod mount. The one or more blades may have a cutting edge that is substantially perpendicular (e.g., within one degree, five degrees, etc.) to a central axis of the vessel.

One or more rods to be sliced are placed in holes that connect an outside surface of the rod mount to an inside surface of the rod mount (outside and inside defined relative to the interior of the cylindrical vessel), thereby forming a shaft. The shaft may be cylindrical, but also may be triangular, squared, hexagonal, or some other shape. The shaft is slightly larger than the rod so that the rod remains vertical, while limiting movement in the horizontal direction but allowing for the rod to slide through. When rods are placed in the holes, gravity and/or the pressure differential created by the pump pulls the rods through the holes into contact with a platform. The platform may be an interior surface of a bottom of the cover vessel or a separate component. In either case, when a rod is passing through a hole and contacting the platform, a predetermined length is between the cutting edge of the blade and the interior surface or platform.

The rod mount is configured to rotate around a shaft on an exterior surface of the cover vessel. As the rod mount rotates, a rod passing through the shaft of the rod mount is brought into contact with a cutting edge of the blade. Thus, the blade slices off a segment of a desired length (the length between the stop or platform and the blade) from the rod. The pressure differential created by the pump causes the segment fall from an opening in the cover vessel into an open portion of the receiving vessel. The remaining rod is then pulled down by gravity and/or the pressure differential to re-contact platform. As the rod mount continues to rotate (either in a single direction or back and forth), additional segments of the desired length are cut from the rod.

The disclosed rod slicer may provide various advantages over existing manual approaches. For example, the distribution of rod segment lengths may be narrower and the loss of manufactured rod due to breakage may be reduced. Furthermore, the rod may be sliced more rapidly, reducing the time spent of laboratory technicians and other personnel producing samples. By way of example, the sliced rod segments may accelerate the extraction of embedded components within an implant.

Example Rod Slicer Configuration

Figure 2:
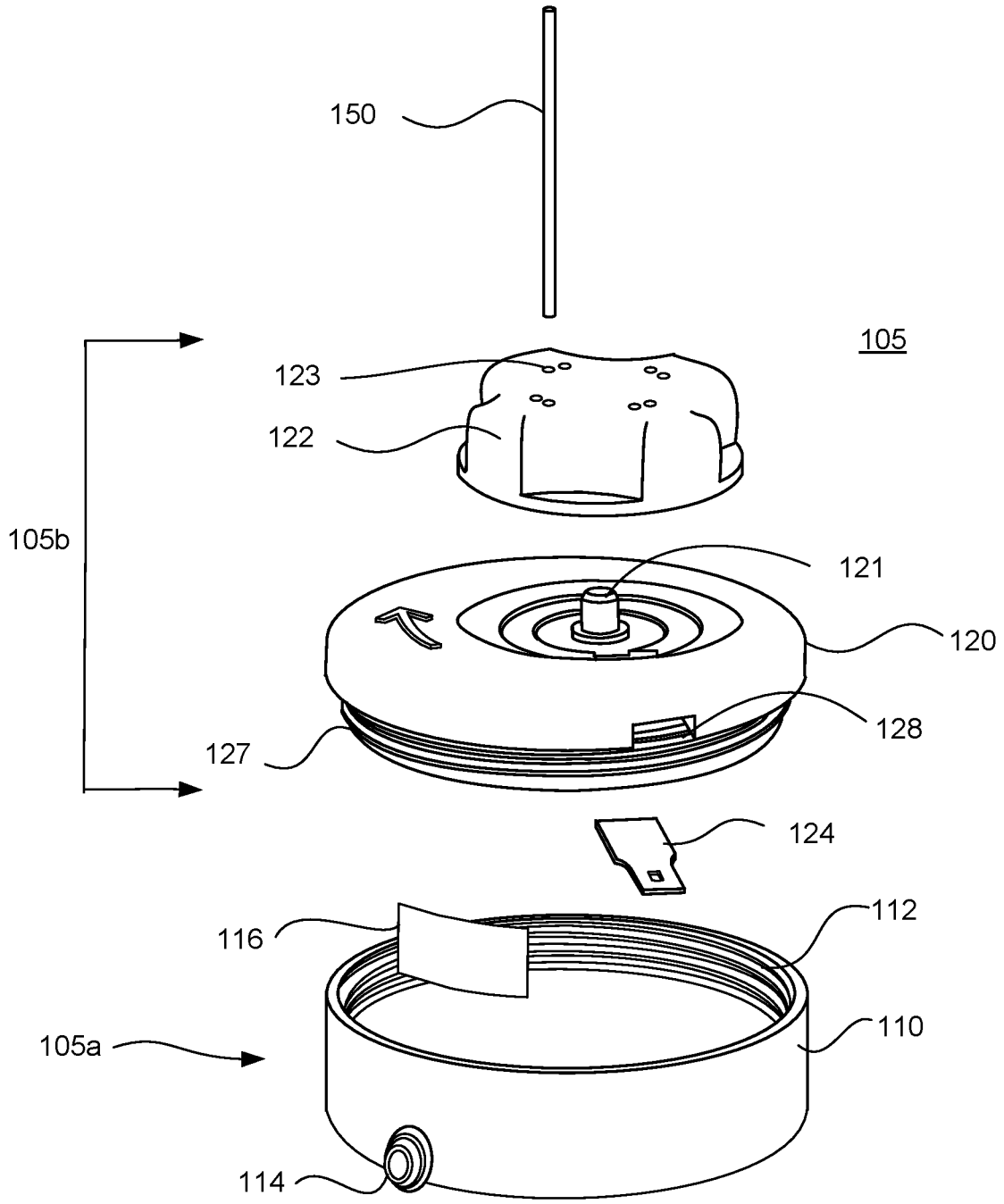
FIG. 2 is an exploded view of an example rotary rod slicer in accordance with one embodiment.

FIGS. 1 and 2 illustrate one embodiment of a rotary rod slicer 105. The rod slicer includes a bottom portion 105*a* and a top portion 105*b*. The bottom portion 105*a* and the top portion 105*b* may be made from a polycarbonate and/or plastic, which may be at least partially translucent. The bottom portion 105*a* may be a cylindrical receiving vessel 110. The receiving vessel 110 includes a bottom and a side. The top of the receiving vessel 110 may be completely open or open in part. Along the side wall is an opening 114 extending from an interior surface to the exterior surface of that side wall. The opening 114 is structured to receive a vacuum tube. The vacuum tube may be connected to a pump to create a pressure differential between the inside and outside of the receiving vessel 110. On adjacent sides of the opening 114 along the interior surface of the side wall of the receiving vessel 110 may be a mounting mechanism 113 (e.g., a rail on each side of the opening 114) structured to receive a grate (or filter) 116. The grate 116 is sized to keep the cut rod particles inside the receiving vessel 110, while using the pressure differential to pull down sliced rods into the cylindrical vessel after being cut as further described below. Alternatively, the grate 116 may allow for the cut portions of the rod to be sucked out individually via the pressure differential (e.g., to be caught or otherwise separated from the gas stream outside of the vessel).

As stated previously, the bottom portion 105*a* may be the receiving vessel 110. Structurally, the top of the receiving vessel 110 may open in full or in part when not covered by the top portion 105*b*. An edge along a top section (opposite the bottom) of the side wall of the receiving vessel 110 may have a reciprocated coupling structure along an outer or inner edge. The reciprocated coupling structure may be threaded 112 along an outer or inner edge to receive (and releasably secure) a threaded edge of the top portion 105*b* of the rod slicer 105. In alternate embodiments, the reciprocated coupling structure along the top section of the side wall of the receiving vessel 110 may be a tongue and groove (e.g., groove with notch) or an inward or outward lip. In this configuration, the structure may receive a reciprocated lip from the top portion 105*b* to couple together the top portion 105*b* and the bottom portion 105*a* of the rod slicer. Non-threaded reciprocated coupling structures may further be sealed using, for example, adhesives, washers, or O-rings.

Turning now to the top portion 105*b*, in one example embodiment, this may include a cover vessel 120 and a rod mount 122. The cover vessel 120 has a bottom, a top, and a side wall. As shown in FIG. 2, along the bottom of the cover vessel 120 are reciprocal threads 127 to couple the threads 112 on the receiving vessel 110. The bottom of the cover vessel 120 is enclosed. The side wall of the cover vessel is substantially enclosed. There may be a small opening 128 from an interior of the side wall to the exterior of the side wall. This opening 128 also could be where the bottom and side wall meet. The opening 128 may be located approximately in the same plane or just below a tip (or end) of a blade 124. The opening 128 provides an outlet where the sliced portions of the rod can be expelled (e.g., via a force from a vacuum coupled with the opening 114) into the receiving vessel 110 of the bottom portion 105*a* of the rod slicer 105.

The blade 124 may be retained in place by a pair of screws 126A, 126B (or other appropriate connectors), e.g., by attaching to the bottom of the cover vessel 120. In one embodiment, the height of the blade 124 relative to the bottom of the cover vessel 120 may be adjusted using the screws 126A, 126B to change the length of the resulting sliced segments of rod. Alternatively, the blade may be fixed in position at a fixed height (e.g., using bolts, screws, adhesives etc.). It is noted that the blade 124 may be replaceable. The blade 124 may be part of an assembly that include a platform that is in a parallel place below the blade 124. In some embodiments, there may be two or more blades in different planes, which may allow for slicing a rod at multiple points simultaneously.

An exterior surface of the top of the cover vessel 120 includes a rotation point, which may be a mounting mechanism (e.g., a mounting axel 121), structured to receive a rotation point of the rod mount 122. The mounting mechanism allows the rod mount 122 to rotate, e.g., clockwise (see arrow), about an axis. The rod mount 122 may be a substantially cylindrical component. The rod mount 122 may include indentations to provide better operator grip, whether human or mechanical grip (e.g., if the rod mount is rotated by a device such as a robotic arm). The rod mount 122 includes one or more circular (or sub-cylindrical) openings 123. The circular openings 123 lead to shaft, which may be cylindrical. The cylindrical shaft may extend from the top surface (e.g., where the rod 150 is inserted) of the rod mount 122 to a bottom surface (e.g., through which the inserted rod 150 emerges) of the rod mount 122. In one embodiment the circular openings 123 may be placed at different radial lengths from the center point of the rod mount 122. This placement may be used to provide differing contact points along an edge of a blade 124, which is further described below.

The circular openings 123 are dimensioned to receive a rod 150 and enable the rod 150 to traverse the shaft through the rod mount 122 towards a stop point. The shaft is slightly larger in diameter than the rod 150 itself to allow the rod 150 to pass through, yet remain substantially vertical as is passes through. This sizing also helps ensure that movement of the rod in the horizontal (or lateral) direction is substantially limited. The stop point may be along a top surface of the cover vessel 120 or may be a separate platform within on which a first (e.g., lead) end of the rod 150 may come to a rest.

Along the top surface (or separate stop component) of the cover vessel 120 is an opening so that a rod 150 passing through the circular openings 123 drop to a platform within the inside of the cover vessel 120 just in front of where an edge of the blade 124 is located. The platform may be the bottom of the interior of the cover vessel or may be separate structure. The mounting mechanism is structured so that when the rod mount 122 is mounted on it, the shafts leading from the circular openings 123 may pass over the cutting edge of the blade 124 when the rod mount is rotated. As the circular openings 123, and corresponding shafts, are at differing radius points from the center of the rod mount 122, the other end of the shaft is exposed along different point along the length of the blade 124. This helps increase life of the blade 124 as it prevents only having one point on the blade 124 being used to slice the rod 150.

Before an edge of the blade 124 may be an opening relative to the platform of the cover vessel 120. The opening may be a result of an assembly that includes the blade 124 and is secured to the cover vessel 120 as further illustrated and described with FIG. 3. The assembly may also include a platform that is in a plane just below a plane of an edge of the blade 124. The height from the edge of the blade 124 to the surface of platform corresponds to what will be the length of the rod 150 is sliced by the edge of the blade 124 upon clockwise rotation of the rod mount 122. The cut (or sliced) portion of the rod 150 can than drop into the vessel 110 through the opening 128. It is noted that the cylindrical shaft though which the rod 150 passes helps keep the rod 150 substantially vertical, while limiting horizontal movement so that when the rod 150 ultimately is sliced it does not shear or fracture at the point of where it is cut.

In one embodiment the cutting edge of the blade 124 extends from a connection point, e.g. near the center within the cover vessel towards the side wall of the cover vessel 120 at a predefined angle, e.g., which may be in a range of a 20 to 40 degree angle and in some embodiments a range of a 25 to 30 degree angle. The blade 124 may be positioned relative to where a circular opening 123 can expose the rod to the blade 124 edge first when it exits the shaft. The rod 150 will be exposed when the rod mount 122 is rotated and the opening of the shaft is exposed to the platform within the cover vessel 120 so that the rod 124 drops towards it. Thus, when the rod mount 122 is rotated about the mounting axel 121, the contents within a circular opening 123 is exposed to the cutting edge of the blade 124 at a radial angle (rather than head on) to slice the rod 150 as the rod mount 122 rotates about the mounting axel 121. The sliced segment of the rod 150 drops into an opening 128 in front of the blade. In one embodiment, the segments of rod may stick to the blade 124, cover vessel 120, or rod mount 122 (e.g., due to static charge) and the pressure differential created by the pump connected to the opening 114 sucks the segments into the body of the vessel 110.

In one embodiment the rod mount 122 may be removably coupled from the mounting axel 121. This enables use of rod mounts having different circular/shaft openings. For example, the circular openings 123 may vary in diameter size to accommodate rods, e.g., 150, of differing diameters. Relatedly, the grate 116 may be structured to have holes of varying diameters to segregate portions of the rods based on the diameter of the rods.

Figure 3:
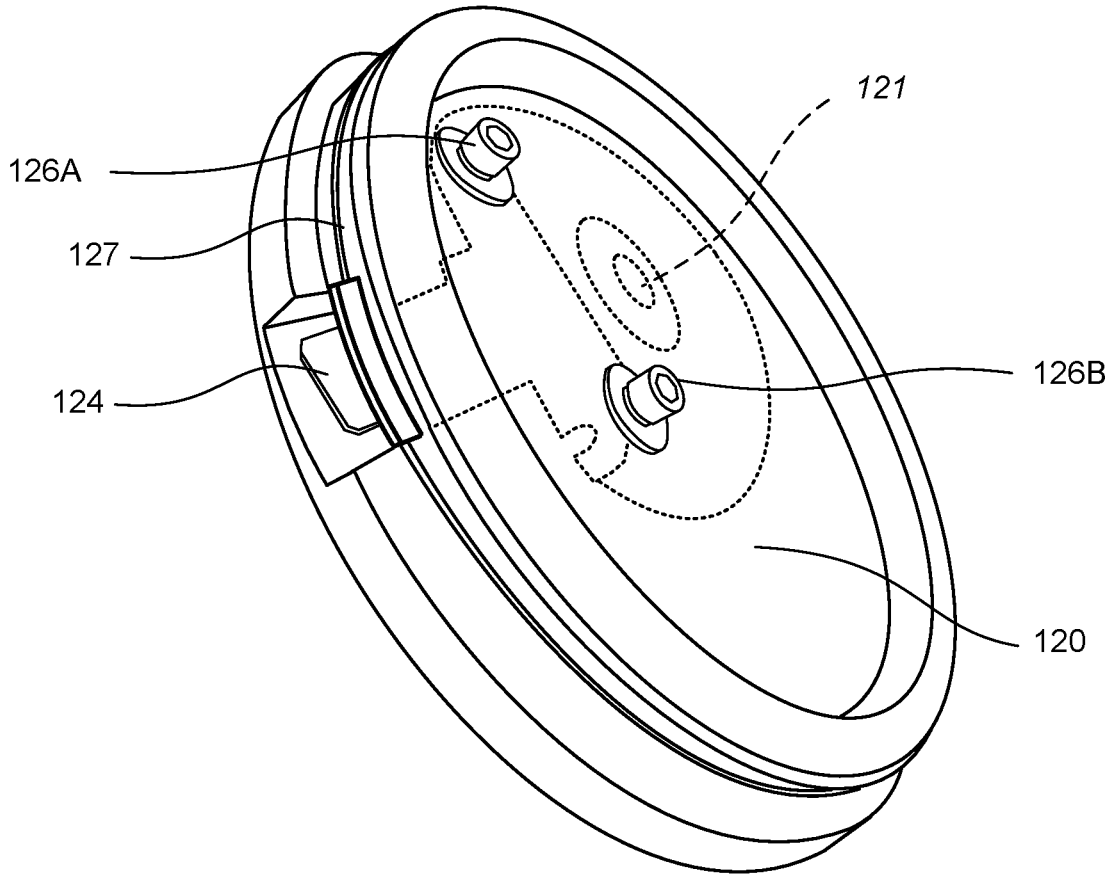
FIG. 3 is a first view of an example cover vessel shown that includes an assembly with a blade 124 mounted in accordance with one embodiment.

FIG. 3 is a first view of an example cover vessel 120 shown that includes an assembly with the blade 124 mounted in accordance with one embodiment. Here, the cover vessel 120 is illustrated from a bottom view in which screws 126A, 126*b* secure an assembly that includes the blade 124 to the bottom of the cover vessel. The assembly may include a platform that is in a plane just below the blade 124. The platform may serve as a floor onto rods 150 dropped through the opening 123 and shaft of the rod mount 122 come to a rest before being sliced by the blade 124.

The assembly with the blade 124 may be secured to the cover at a location that aligns close to the axis of the mounting axel 121. Hence, the blade extends outward from approximately where the assembly is secured towards the wall of the cover vessel 120. The blade 124 if further mounted so that its tip, or end, remains within wall when rotated. The blade 124 may be positioned at a rotation angle that may be, for example, with a range of 25 to 30 degrees, but could be in the range of 20 to 40 degrees. The angular rotation angle beneficially allows for a cleaner slicing of the rod 150 when it drops onto the platform of the assembly with the blade and as the rod mount 122 is quickly rotated so the shaft with the rod 124 passes over the edge of the blade 124.

Example Operation of Rod Slicer

Figure 4:
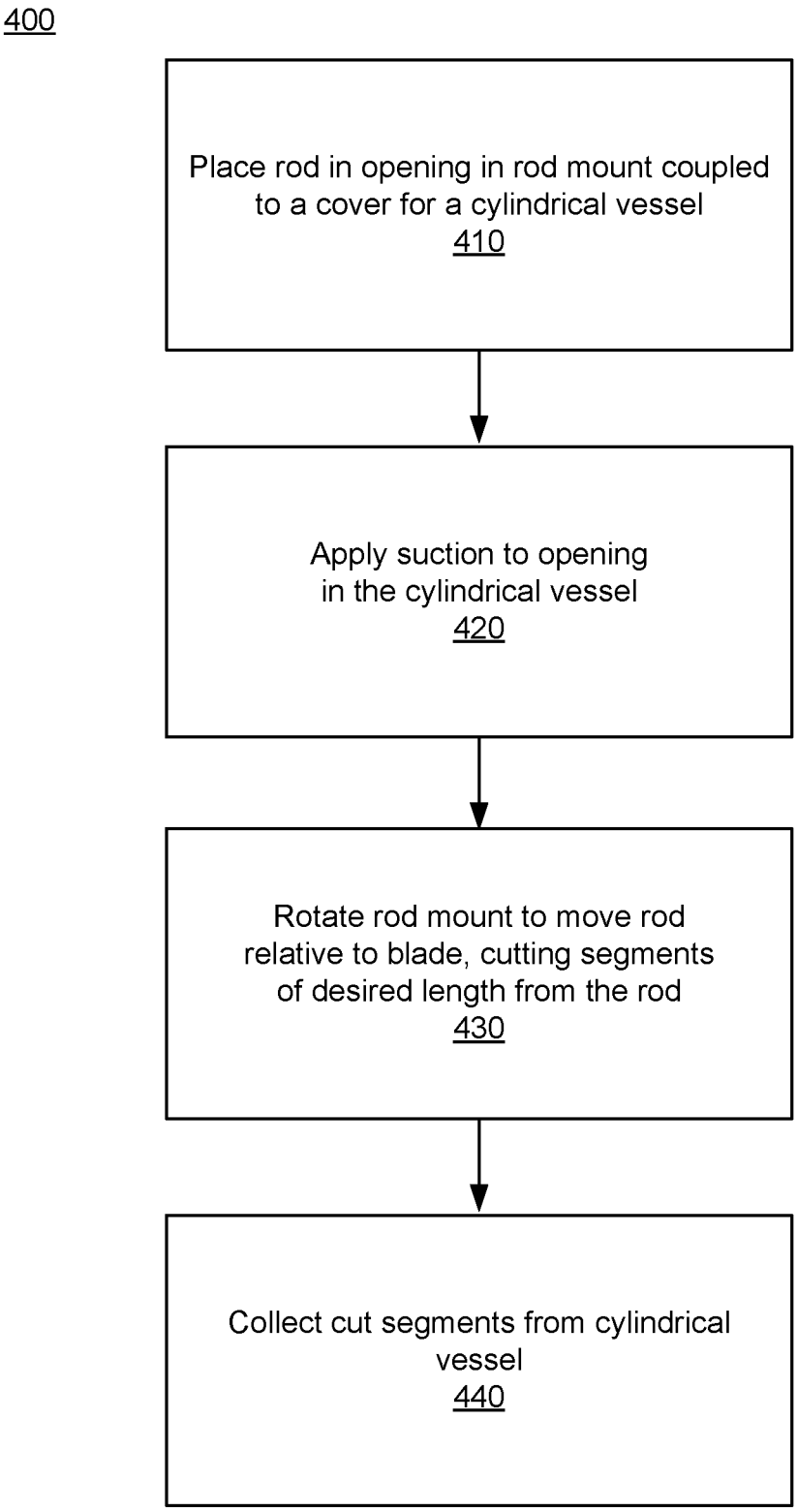
FIG. 4 is a flowchart illustrating an example method for using the rotary rod slicer in accordance with one embodiment.

FIG. 4 illustrates one embodiment of an example operational process 400 for slicing segments of desired length from a rod, e.g., 150, using the rod slicer 105. Other embodiments may perform some steps in parallel, perform the steps in different orders, or perform different steps. In the embodiment shown, a rod 150 is placed 410 in an opening 123 to a shaft of the rod mount 122.

The rod 150 is inserted into the circular opening 123 on first (e.g., lead) end. The rod 150 passes through the opening and cylindrical shaft until it comes to a rest on the top surface of the cover vessel 120 or a platform. As the rod mount 122 is rotated clockwise, the rod 150 moves along with it due it being enclosed within the shaft. When an opening of the end of the shaft lines up with an opening on the surface of the cover vessel 120, the rod 150 drops into the cover vessel onto a platform, e.g., interior surface of the bottom of the cover vessel 120. This location may be in front of the edge of the blade 124. As the rod mount 122 may be in continual rotation at this point, the dropped rod 150 is sliced by the edge of the blade 124 as it sweeps in front of it.

As the rod 150 traverses the cylindrical shaft through which the rod 150 is inserted, it passes through in the vertical direction but its movement in the horizontal direction is constrained or otherwise limited as the diameter of the shaft is slightly larger than the diameter of the rod 150. This configuration prevents the rod 150 from fracturing or shearing off when the edge of the blade 124 slices the rod 150. It is noted that when the rod mount 122 includes more than one sub-cylindrical opening 123, a rod may be placed in each circular opening 123 or a subset of the sub-cylindrical openings 123. Thus, multiple rods may be sliced into segments of the desired length when the rod mount 123 is continuously rotated for some number of turns. Moreover, the rods may be cut in a matter that limits or eliminates fracturing, shearing or otherwise breakage of the rod as it is cut at the point where the edge of the blade 124 meets each rod.

Suction may be applied 420 to the opening 114 to help facilitate the movement of the sliced rods. For example, the suction may create a downward force within the shaft of the cover vessel 120 and also from the cover vessel 120 to the receiving vessel 110. Although the flow chart is shown as occurring after placement 410 of the rod, the suction may be applied 420 before or in parallel to rod placement. The suction also may continue to be applied for some or all of the remainder of the operational process 400.

As previously noted, the rod mount 122 may be rotated 430 clockwise in one embodiment to move the rod for positioning in front of the edge of the blade 124. In one embodiment, the rod mount 122 may be rotated by a human operator. In other embodiments, the rod mount may be rotated 430 automatically, such as by a robotic arm and/or may be part of a rotational motor coupled to the rod mount.

Regardless of the rotation mechanism, as the rod mount 122 rotates, the rod 150 moves with it while remaining in the vertical direction as horizontal movement is restricted by the shaft. As the rod 150 is rotated via the rod mount 122 it transverses an opening just before a cutting edge of the blade 124. The opening enables the rod 150 to drop down further to a second surface or platform). The drop of the rod 150 further down and movement created the rotational angle of the rod 150 positional relative to a cutting edge of the blade 125 allows the edge of the blade to slice a portion (or segment) of the rod 150 at a desired length.

The sliced portion of the rod 150 falls into the receiving vessel 110 due to gravity and/or the force differential resulting from the applied 420 suction. Once sliced, the rod 150 in the cylindrical shaft is ready to once again come down to the platform in front of the blade 124 as the rod mount 122 is rotated and be slices again. The rod mount 122 may continue to be rotated 430 until a desired amount of the rod 150 has been sliced into segments of the desired length. The cut segments may then be collected 440 from the receiving vessel 110 (e.g., by unscrewing the cover and removing the cut segments). Alternatively, in another embodiment, the cut segments are sucked from the receiving vessel 110 by the suction and removed from the flow of gas using a filter or other separation mechanism outside of the vessel.

The sliced segments may be used in the context of medical implants. For example, the sliced rod segments may accelerate the extraction of embedded components within an implant and/or in testing environments with implants.

Additional Considerations

As used herein, any reference to "one embodiment" or "an embodiment" means that a particular element, feature, structure, or characteristic described about the embodiment is included in at least one embodiment. The appearances of the phrase "in one embodiment" in various places in the specification are not necessarily all referring to the same embodiment.

Some embodiments may be described using the expression "coupled" and "connected" along with their derivatives. It should be understood that these terms are not intended as synonyms for each other. For example, some embodiments may be described using the term "connected" to indicate that two or more elements are in direct physical or electrical contact with each other. In another example, some embodiments may be described using the term "coupled" to indicate that two or more elements are in direct physical or electrical contact. The term "coupled," however, may also mean that two or more elements are not in direct contact with each other, but still co-operate or interact with each other. The embodiments are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments. This is done merely for convenience and to give a general sense of the disclosure. This description should be read to include one or at least one and the singular also includes the plural unless it is obvious that it is meant otherwise.

Upon reading this disclosure, those of skill in the art will appreciate still additional alternative structural and functional designs for a system and a process for a rotary rod slicer. Thus, while particular embodiments and applications have been illustrated and described, it is to be understood that the described subject matter is not limited to the precise construction and components disclosed herein and that various modifications, changes and variations which will be apparent to those skilled in the art may be made in the arrangement, operation and details of the method and apparatus disclosed. The scope of protection should be limited only by the following claims.

What is claimed is:

1. A rod slicer assembly for slicing medical implant rods, the rod slicer comprising:

a receiving vessel comprising a bottom having an interior surface and an exterior surface, a side wall having an interior surface and an exterior surface, and an at least partially open top section, an edge of the side wall having a first part of a reciprocated coupling structure;

a rod mount, the rod mount including a rotation point at a center and having at least one cylindrical shaft at a first radius length from the center and open on a top surface and a bottom surface and passing through the rod mount from the top surface to the bottom surface, the cylindrical shaft structured to receive a rod inserted via the opening at the top of the cylindrical shaft for passing to the opening of the bottom of the cylindrical shaft; and a cover vessel comprising a top having an exterior surface and an interior surface, a side wall, and a bottom having an exterior surface and an interior surface, the exterior of the top having a shaft structured to rotatably coupled with the rotation point, the exterior of the top having a first area exposed to the opening of the bottom of a cylindrical shaft of the rod mount and a second area open towards the interior of the bottom of the cover vessel, the cover vessel having a blade mounted to the bottom, and further having an opening before an edge of the blade in alignment with the opening of the side wall, the edge of the blade in a different plane than the interior surface of the bottom of the cover, an edge of the side wall having a second part of the reciprocated coupling structure for coupling with the first part of the reciprocated coupling structure.

2. The rod slicer of claim 1, wherein the first part of the reciprocated coupling structure is along a top edge of the exterior surface side wall.

3. The rod slicer of claim 2, wherein the second part of the reciprocated coupling structure is along a bottom edge of the side wall of the cover vessel.

4. The rotary rod slicer of claim 3, wherein the first part of the reciprocated coupling is a first threaded part.

5. The rod slicer of claim 4, wherein the second part of the reciprocated coupling is a second threaded part.

6. The rod slicer of claim 1, wherein the side wall of the receiving vessel includes an opening between the interior surface and the exterior surface of the side wall of the receiving vessel, the opening structured for connection to a pump along the exterior surface of the side wall.

7. The rod slicer of claim 6, wherein opening on the interior surface of the side wall includes adjacent rails to hold a grate.

8. The rod slicer of claim 1, wherein the blade is positioned to contact a rod at predefined rotational angle.

9. The rod slicer of claim 8, wherein the rotation point of the rod mount couples with the shaft on the exterior surface of the cover for clockwise rotation.

10. The rod slicer of claim 9, wherein the rotation point comprises a mounting axel.

11. The rod slicer of claim 1, wherein at least one of the rod mount, the receiving vessel and the cover vessel cover comprises a plastic or a polycarbonate.

12. The rod slicer of claim 1, wherein the blade is removably coupled with the bottom of the cover.

13. The rod slicer of claim 12, wherein the blade is positioned at a rotational angle within a range of 20 to 40 degrees.

14. The rod slicer of claim 13, wherein a second cylindrical shaft on the rod mount is positioned at a second radius length from the center, the first radius length being different from the second radius length.

15. The rod slicer of claim 1, wherein the edge of the blade is between 1 millimeter to 10 millimeters above the interior surface of the bottom of the cover vessel.

16. A rotary rod slicer assembly for slicing medical implant rods, the rotary rod slicer comprising:

a first means for housing comprising a bottom having an interior surface and an exterior surface, a side wall having an interior surface and an exterior surface, and an at least partially open top section, an edge of the side wall having a means for coupling structure;

a means for rotation, the means for rotation including a rotation point at a center and having at least one cylindrical shaft at a first radius length from the center and open on a top surface and a bottom surface and passing through the rod mount from the top surface to the bottom surface, the cylindrical shaft structured to receive a rod inserted via the opening at the top of the cylindrical shaft for passing to the opening of the bottom of the cylindrical shaft; and a second means for housing comprising a top having an exterior surface and an interior surface, a side wall, and a bottom having an exterior surface and an interior surface, the exterior of the top having a shaft structured to rotatably coupled with the rotation point of the means for rotation, the exterior of the top having a first area exposed to the opening of the bottom of a cylindrical shaft of the rod mount and a second area open towards the interior of the bottom of the cover vessel, the second means for housing having a means for slicing mounted to the bottom, and further having an opening before an edge of the means for slicing in alignment with the opening of the side wall, the edge of the means for slicing in a different plane than the interior surface of the bottom of the second means for housing, an edge of the side wall having a second means for coupling for coupling with the first means for coupling in reciprocated manner.

17. The rotary rod slicer of claim 16, wherein the means for slicing comprises a blade removably coupled with the bottom of the cover.

18. The rotary rod slicer of claim 17, wherein the blade is positioned at a rotational angle within a range of 20 to 40 degrees.

* * * * *